United States Patent [19]

Geissler

[11] 3,968,793

[45] July 13, 1976

[54] CLAMPING RING FOR THE WINDOW FRAME OF A BREATHING MASK

[75] Inventor: Rolf Geissler, Berlin, Germany

[73] Assignee: Auergesellschaft GmbH, Berlin, Germany

[22] Filed: Mar. 27, 1975

[21] Appl. No.: 562,409

[30] Foreign Application Priority Data

Mar. 28, 1974 Germany ..... 2415492

[52] U.S. Cl. ..... 128/141 R; 128/142.4; 2/2.1 R; 285/367; 285/310; 24/279; 24/20 LS

[51] Int. Cl.[2] ..... A62B 9/04

[58] Field of Search ..... 128/141 R, 141 A, 142, 128/142.2, 142.3, 142.4, 142.7, 146, 145 R, 145 A, 146.7, 147; 2/2.1 R, 2.1 A, 14 R, 14 B, 14 D, 14 E, 14 F, 14 K, 14 W, 205; 285/367, 410, 411; 24/20 LS, 20 W, 20 TT, 25 R, 24 R, 20 R, 279, 284, 285

[56] References Cited

UNITED STATES PATENTS

| | | | |
|---|---|---|---|
| 3,251,615 | 5/1966 | Short | 24/284 |
| 3,259,127 | 7/1966 | Klinger et al. | 128/142.4 |
| 3,315,673 | 4/1967 | Morton, Jr. | 128/141 R |
| 3,579,754 | 5/1971 | Oetiker | 24/279 |

*Primary Examiner*—Robert W. Michell
*Assistant Examiner*—Henry J. Recla
*Attorney, Agent, or Firm*—Brown, Murray, Flick & Peckham

[57] ABSTRACT

The viewing window at the front of a breathing mask is held in a groove in a flexible frame that is clamped in a ring formed from two channel-shape half rings engaging each other at their ends and having on the outside of their end portions pairs of laterally projecting vertical flanges so that those end portions are H-shaped in cross section. Each pair of the engaging ends of the half rings is provided with a guide member projecting vertically from one of the half rings into the space between the flanges of the other half ring, and a bolt is rotatably disposed in a cross member between the flanges of the other half ring. The bolt extends through the adjacent guide member and has a nut on its end so that the ends of each half ring can be drawn into contact with the ends of the other half ring to hold the half rings together. The inner surfaces of the side walls of the half rings beside the bolts may diverge toward the ends of the rings.

9 Claims, 8 Drawing Figures

CLAMPING RING FOR THE WINDOW FRAME OF A BREATHING MASK

The invention concerns a clamping ring for the flexible frame that retains the window of a breathing mask, such as a respirator mask or a gas mask, where a single window fits into a groove in the frame at the front of the mask. The clamping ring includes two half rings having a U-shaped cross section so that a channel is formed that receives the window frame. The half rings preferably are made of fiber-glass reinforced plastic, and their ends are provided with connecting members for pulling the two parts of the ring together. The clamping ring is placed around the window frame and not only grips the front but also the back of the frame, thus serving to provide a firm gas-tight joint between the mask and the window.

In a known clamping ring that is made of two halves and that is so mounted on the frame for the mask window that the edge of the window is not subjected to radial pressure, the two ends of each half ring are provided with fittings, each of which is bored to accept a screw by means of which the fittings, and hence the clamping ring halves, can be pulled together. Because they lie at an appreciable distance behind the front line of the clamping ring, the fittings are provided with a sloping contact face in order to attain the required lateral pressure on the window. That form of construction, however, does not prevent the flexible frame for the window from bulging and coming between the clamping ring halves at the joints, thus causing leaks to occur.

The same also applies to another two-piece clamping ring which is made of metal and to which liners are attached as connecting members. In this case, the ring halves are drawn together solely by means of screws, without the ends of the two halves coming into contact with each other. The distorted flexible frame is clamped between them. However, the distorted frame assumes stresses that are not attained when mounting the clamping ring and produces an undefined point in the frame that gives rise to difficulties in sealing the window tightly in the mask, especially when the window happens to be curved horizontally.

Mounted interchangeably at one end of half of a clamping ring of still another type of mask is a bored-out dowel pin that is pulled into a hole located at the end of the other half of the ring. By this means, the clamping ring halves are brought together into proper position. In this case, also, the constructions of the ring and of the round dowel pins do not prevent the flexible frame from distorting, thus failing to eliminate the sealing difficulties. Along with this drawback, the clamping ring exerts a radial pressure on the edge of the viewing window, which also is undesirable.

The objective of this invention is the construction of a clamping ring for the window frames of breathing masks to provide two substantially identical half rings, the construction being such that the ring is both strong and easy to produce and so designed that the window can be changed easily while, at the same time, ensuring a perfectly tight seal between the window and the body of the mask.

This objective is attained in accordance with this invention by providing the end portions of the clamping ring halves with pairs of laterally projecting vertical flanges so that there is produced at those end portions an H-shaped profile. The clamping ring halves are provided with guide members whose dimensions are such that they can be pulled into the spaces between the flanges of the half rings by means of bolts and nuts which are disposed in a captive manner in cross members between the flanges, whereby the ends of the half rings can close up snugly in contact with each other. The space between the side walls of the clamping ring broadens out vertically towards the ends of the clamping ring halves in the region of the bolts.

Because the flexible frame that receives the window is so constructed that after inserting the window the outer surface of the frame diverges away from the periphery of the frame, the side walls of the clamping ring likewise diverge to a like extent. By this means, it is possible to achieve a uniform sealing pressure against the two sides of the window.

Advantageously, the outer side wall of the clamping ring can be provided with a projection which is bent or crimped inwardly towards the window frame to exert additional pressure on the periphery of the frame, thereby preventing, in particular, the entry of dust particles at the sealing surfaces.

Another form of construction in accordance with the invention is that the clamping ring halves are provided with center markings. This makes assembly easier in that it is necessary only to bring into alignment the center molding ridge of the mask, the center markings of the window and the center markings of the clamping ring in order to attain accurate matching of the parts.

The invention provides the special advantages that the window can be installed free from stress; that is, without the danger of the formation of stress cracks, and can be easily changed if required. It is also possible to install, without difficulty, windows made of another material such as, for example, laminated glass. The clamping ring, when made of fiber-glass reinforced plastic, along with the permanently installed connecting pieces in the ring, allows for the manufacture of a simple component having high rigidity. This enables the part to be heavily stressed, which allows a correspondingly high sealing pressure to be employed. Non-uniform buckling of the flexible window frame near the joints between the clamping ring halves, with the possibility of permanent distortion, is prevented so that a permanent uniform seal is obtained around the entire periphery of the window.

The invention is illustrated in the accompanying drawings, in which

Figure 1:
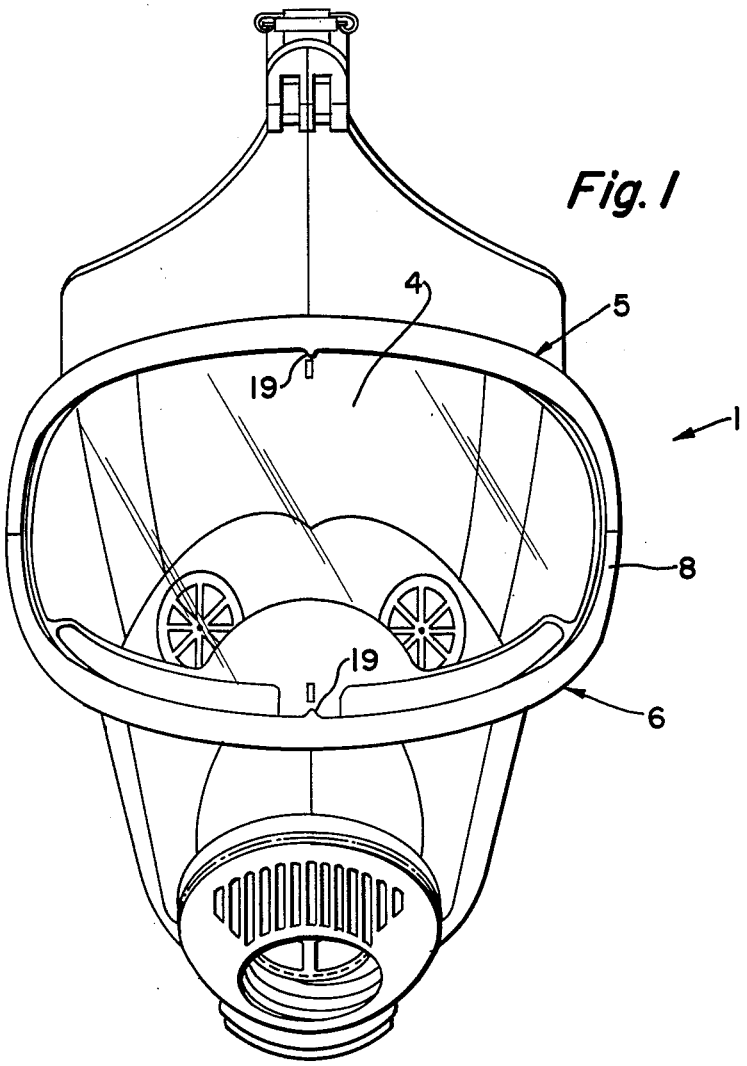
FIG. 1 is a front view of a breathing mask.
Figure 2:
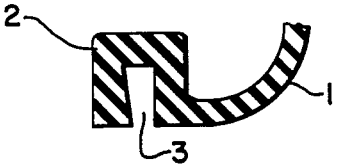
FIG. 2 is an enlarged fragmentary cross section of the flexible frame for the window.

Referring to the drawings, the front of a breathing mask 1 is provided with a large opening surrounded by a thick flexible bead 2 provided with a groove 3 in which the edge of a viewing window 4 is mounted and firmly retained in place by means of a clamping ring having two identical halves 5 and 6. The window usually is curved horizontally as shown.

Figure 3:
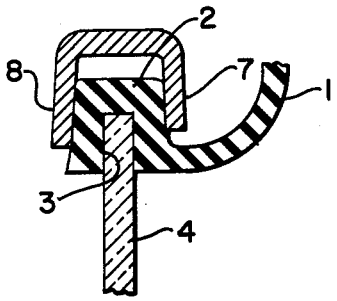
FIG. 3 is an enlarged fragmentary cross section of the clamping ring and the window frame prior to the clamping operation.
Figure 4:
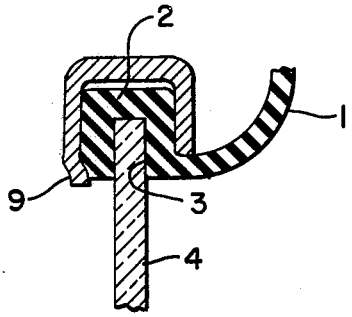
FIG. 4 is an enlarged fragmentary cross section of the clamping ring and a modified frame after the clamping operation.

The cross section of the window frame formed by the grooved bead 2 is so designed that the frame exerts a certain lateral pressure on viewing window 4. When the window is inserted in groove 3, the frame spreads out so that its sides diverge toward the center of the window as shown in FIG. 3. In order for the channel-like clamping ring to apply a uniform sealing pressure, its side walls also flare out towards its open side at a slight angle. The inner side wall 7 of the clamping ring is made shorter than its outer side wall 8 to conform to the side of the window frame that joins the body of the mask. If desired, as shown in FIG. 4, the outer side wall of the clamping ring may have an extension 9 that is bent in towards the flexible frame and thus increases the lateral pressure of the clamping ring against the frame.

Figure 5:
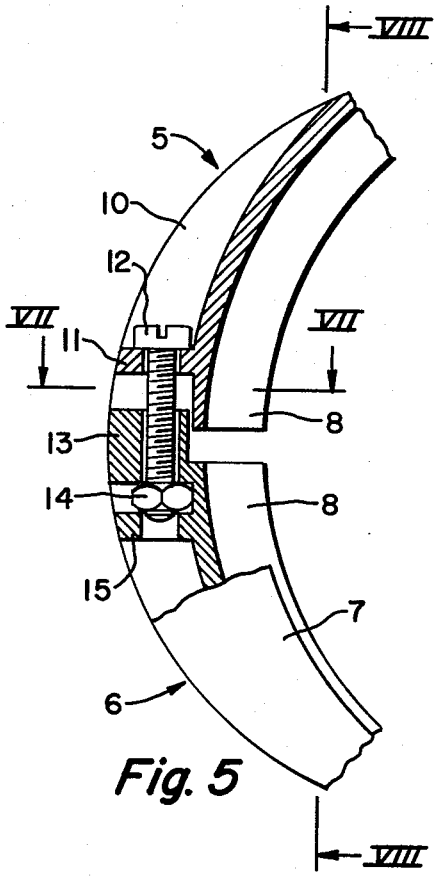
FIG. 5 is a front view of the junction between the ring halves in partial cross section.
Figure 6:
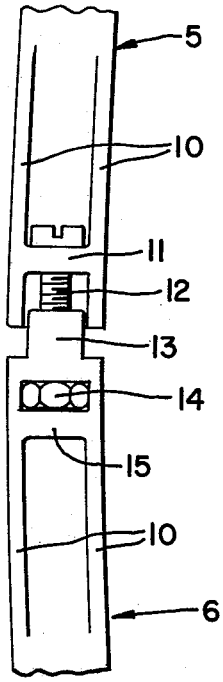
FIG. 6 is a side view of the junction between the ring halves.
Figure 7:
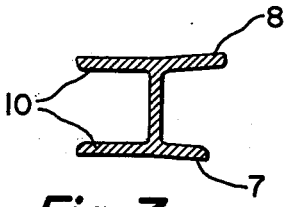
FIG. 7 is a section taken on the line VII—VII of FIG. 5.

The opposite end portions of each half ring 5 and 6 are each provided with a pair of parallel laterally extending vertical flanges 10 that appear to be extensions of the side walls of the ring, whereby as shown in FIG. 7 the ring has an H-shape cross section in those areas. As shown in FIGS. 5 and 6, the flanges of the upper half ring 5 are connected near their lower ends by an integral cross member 11, down through which a bolt 12 extends. The bolt also extends down through a rectangular guide block 13 projecting from the lower half ring 6 up between flanges 10 of the upper half ring to serve as a guide as the two half rings are drawn together. A nut 14 is screwed on the lower end of the bolt above a cross member 15 connecting flanges 10 of the lower half ring. At the opposite side of the clamping ring the lower half ring may be provided with a similar guide member 13, but it is preferred to make both half rings identical, so the other guide member should extend downwardly from the upper half ring and the bolt should extend upwardly. The bolts 12 at the opposite sides of the clamping ring permit the ends of the two half rings to be pulled vertically into engagement with each other to form a continuous unbroken ring. The dimensions of the clamping ring are such that when its two halves are pulled together so that their ends make contact, a gap 16 remains between the periphery of the flexible window frame and the ring so that the viewing window is not subjected to radial pressure by the ring.

Figure 8:
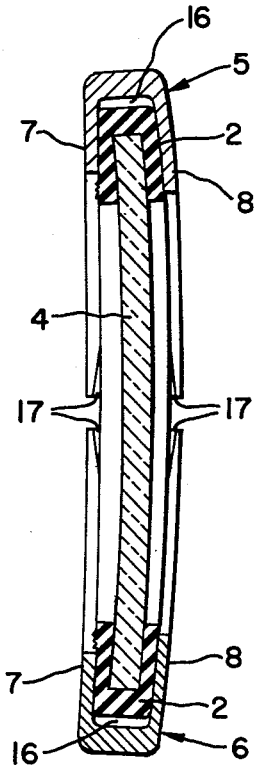
FIG. 8 is a side view taken on the line VIII—VIII of FIG. 5, but also showing the window and the frame alone in vertical section.

As shown in FIG. 8, the inner surfaces 17 of the side walls of the clamping ring at the ends of the half rings diverge vertically towards the meeting ends of those walls so that more space is provided for possible bulging of the flexible frame in those areas, and any uneven bulging of the flexible frame is prevented. A centering point 19 is formed on the front face of each clamping ring half to simplify accurate assembly of the window and frame and clamping ring.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A clamping ring for a breathing mask viewing window held in a groove in a flexible frame at the front of the mask, the ring comprising two channel-shape half rings engaging each other at their ends and having on the outside of each of their end portions a pair of laterally projecting vertical flanges so that said end portions are H-shape in cross section, each pair of said engaging ends being provided with a guide member extending between the flanges of one of the half rings and projecting vertically from the end portion of said one of the half rings into the space between the flanges of the other half ring, a cross member extending between said flanges of said other half ring and spaced from the end portion of said other half ring, said cross member and said guide member each having a bore therethrough in axial alignment, a bolt rotatably mounted in each bore through said cross member and the adjacent guide member, and a nut on the end of each bolt, whereby the ends of each half ring can be drawn into contact with the ends of the other half ring to hold the half rings together.

2. A clamping ring in accordance with claim 1, in which the guide members project from one end of one half ring and from the other end of the other half ring, whereby said half rings are identical.

3. A clamping ring in accordance with claim 1, in which the side walls of the clamping ring diverge toward its open side.

4. A clamping ring in accordance with claim 1, in which said half rings are rigid.

5. A clamping ring in accordance with claim 1, in which said half rings are made of fiber-glass reinforced plastic and are rigid.

6. A clamping ring in accordance with claim 1, in which the inner surfaces of the side walls of the half rings beside said bolts diverge towards the ends of the rings.

7. A clamping ring in accordance with claim 1, in which the outer side walls of the clamping ring halves are provided with centering marks.

8. A clamping ring in accordance with claim 1, in which the outer side wall of the clamping ring is provided with an extension turned inwardly toward the window.

9. A clamping ring in accordance with claim 1, in which each of said guide members is rectangular in horizontal cross section and nearly as wide as the space into which it projects.

* * * * *